US005193786A

United States Patent [19]

Guenther

[11] Patent Number: 5,193,786

[45] Date of Patent: Mar. 16, 1993

[54] MODULAR HAND RAIL

[75] Inventor: Torbett B. Guenther, Plymouth Twp., Wayne County, Mich.

[73] Assignee: TPI of Alter Park, Plymouth, Mich.

[21] Appl. No.: 776,794

[22] Filed: Oct. 15, 1991

[51] Int. Cl.[5] ..... E04H 17/14

[52] U.S. Cl. ..... 256/69; 256/65; 256/59; 403/295

[58] Field of Search ..... 256/59, 65, 69; 403/295

[56] References Cited

U.S. PATENT DOCUMENTS

| | | |
|---|---|---|
| 809,670 | 1/1906 | Covert . |
| 2,147,028 | 2/1939 | Gundelfinger . |
| 2,815,972 | 12/1959 | Lagervall . |
| 2,940,719 | 6/1960 | Taubman . |
| 3,278,209 | 10/1966 | Winikoff . |
| 3,804,542 | 4/1974 | Hammerschmidt . |
| 4,013,372 | 3/1977 | Lay et al. . |
| 4,193,586 | 3/1980 | Guenther . |
| 4,415,141 | 11/1983 | Guenther . |
| 4,683,609 | 8/1987 | Trubiano . |
| 4,737,047 | 4/1988 | Oshita . |
| 4,802,785 | 2/1989 | Richards . |
| 4,810,144 | 3/1989 | Martelli . |
| 4,890,954 | 1/1990 | Richards . |
| 4,952,092 | 8/1990 | Ballerstein . |

FOREIGN PATENT DOCUMENTS

| | | | |
|---|---|---|---|
| 2904776 | 8/1980 | Fed. Rep. of Germany | 403/295 |
| 300460 | 12/1990 | Japan | 256/59 |

*Primary Examiner*—Andrew V. Kundrat
*Attorney, Agent, or Firm*—Barnes, Kisselle, Raisch, Choate, Whittemore & Hulbert

[57] ABSTRACT

A modular hand rail comprises a tubular length of material attached to at least one elbow section. The assembly is easily mounted to a wall to aid elderly or disabled persons in moving about. Use of different colors or materials provides in an aesthetically pleasing appearance, flexibility in design and aids the user in delineating the gripping portion in areas of little or no light.

19 Claims, 3 Drawing Sheets

MODULAR HAND RAIL

BACKGROUND OF THE INVENTION

This invention is directed to a modular hand rail. It is common to provide wall bars or hand rails in private homes and public buildings to permit elderly and disabled persons to move about. Such rails are usually mounted to extend along a wall and must have sufficient strength to withstand the weight of a user that is applied thereto.

Such hand rails usually comprise a single length of solid or tubular material such as metal and are constructed to be mounted to a wall through stamped mounting flanges or brackets welded to the rail, such as the wall bar disclosed in U.S. Pat. No. 4,415,141. Other prior art hand rails formed from a single piece of material must have end portions bent and cut at certain angles for mounting the rail to a wall, such as in U.S. Pat. No. 4,193,586. These prior art hand rails posses only limited mounting capabilities and design and have an industrial or institutional appearance.

It is an object of this invention to provide an aesthetically pleasing hand rail that is easily manufactured. Another object of the invention is to provide a hand rail system with design flexibility that can be easily mounted to a wall. Yet another object of the invention is to provide a hand rail which helps the user delineate the gripping portion from the mounting structure, particularly in areas where there is little or no light available.

SUMMARY OF THE INVENTION

In accordance with the invention, the wall bar comprises a length of tubular material attached to at least one plastic elbow section which connects the hand rail to the wall. The entire assembly may be made of plastic having one color or the length of tubular material may be of different colored plastic. The length of tubular material may be made of other aesthetically pleasing materials, such as satin finished stainless steel, or polished brass. Choice of color and the use of mixed materials allow for design flexibility. Spacers are also provided between the tubular length and the elbow sections to help delineate the gripping area therefrom. In areas of little or no light, spacers or a tubular length made from luminous material may be used.

DETAILED DESCRIPTION OF THE INVENTION

Figure 1:
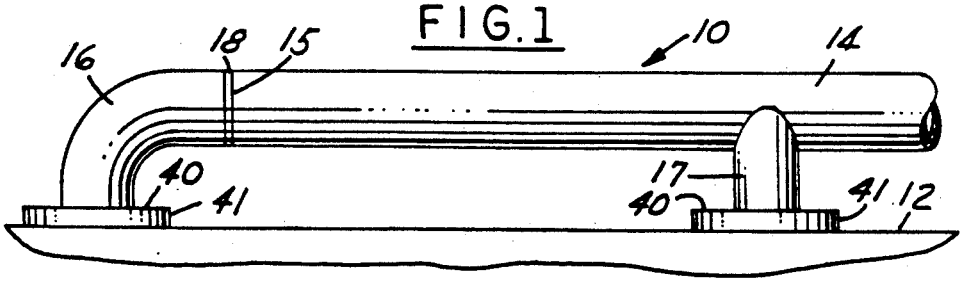
FIG. 1 is a fragmentary plan view of a hand rail embodying the invention.
Figure 2:
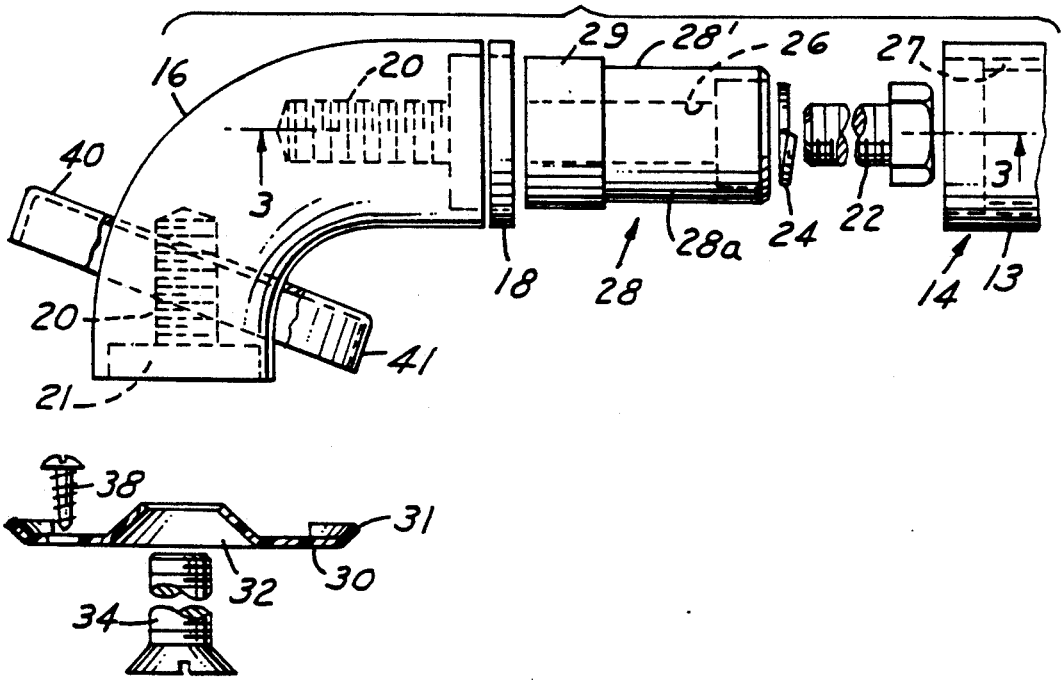
FIG. 2 is a fragmentary exploded assembly view of one embodiment of the invention.

Referring to FIG. 1, the hand rail assembly 10 comprises a tubular plastic length of material 14 having two ends 15 (only one of which is shown) attached to plastic elbow sections 16 to be connected to the wall 12. An additional center support 17 is shown and may be used if necessary, but is not required. A spacer 18 is provided between the end 15 of the tubular length 14 and an end of the elbow section 16 to help delineate the tubular length of material 14, which is used as a gripping portion, from the elbow sections 16. The elbow sections 16 appear in the drawings as 90° elbows; however, it is understood that the elbow sections could be more or less than 90°.

Figure 3:
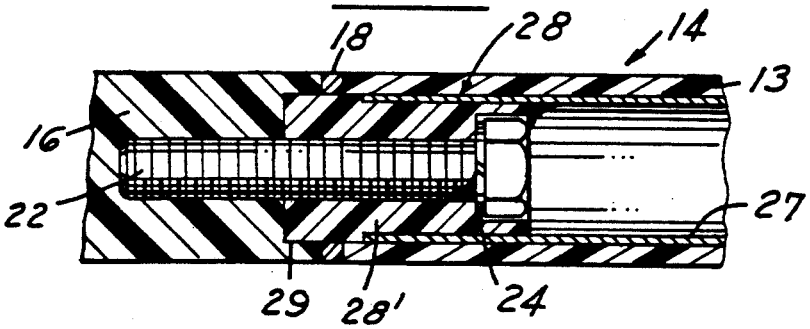
FIG. 3 is a sectional view of the assembled embodiment of FIG. 2 taken along line 3—3.
Figure 4:
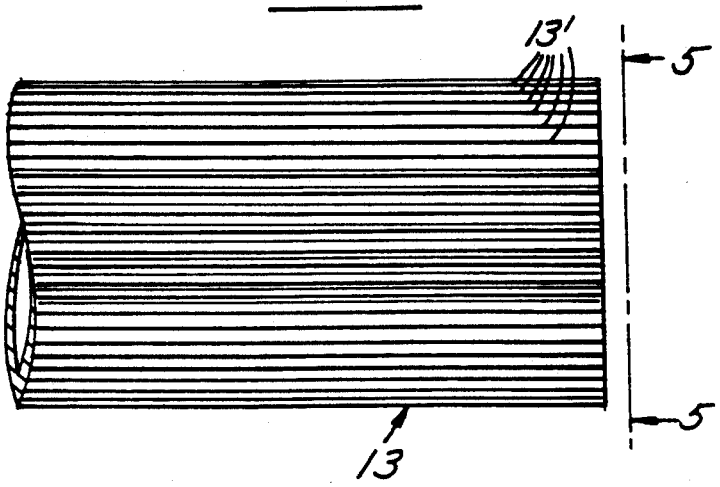
FIG. 4 is a fragmentary view of the plastic tube with longitudinal ribs.
Figure 5:
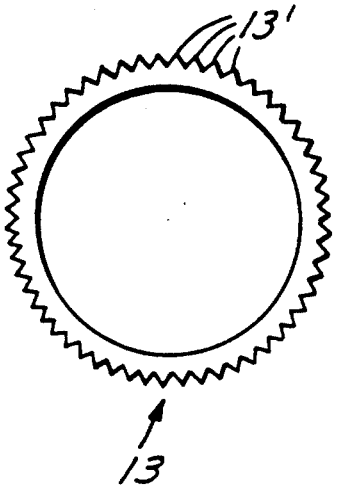
FIG. 5 is a view taken along line 5—5 in FIG. 4.

A preferred form of the invention is shown in FIGS. 2–5. In this embodiment, the tubular length of material consists of an inner metal sleeve 27 press fit within plastic tubing 13 to form the tubular length 14. If necessary, the metal sleeve may be secured to the plastic tubing with an adhesive. The plastic tubing 13 is an extrusion having longitudinal ribs 13' along the length to provide a non-slip gripping surface as seen in FIGS. 4 and 5. The tubular length is connected to one end of the elbow section 16 through a plastic insert 28. The insert has a head portion 29 a shank portion 28' with longitudinal serrations 28*a* along the length thereof. A counterbored hole 26 extends axially therethrough to receive a fastener such as a bolt 22 and lock washer 24. The bolt 22 and lock washer 24 are inserted into the counterbored hole 26 in the plastic insert 28 to form a subassembly which is then press fit into the tubular length 14. The serrations 28*a* provide frictional engagement with the inner surface of the metal tube 27 to ensure against rotation. As can be seen in FIG. 3, the shank 28' of the plastic insert 28 is entirely received within metal tubing 27. The metal tubing 27 does not extend through the entire length of the plastic tubing, thus allowing the head portion 29 of the plastic insert 28 to abut against the end of the metal tubing 27 while a portion of the outer periphery of the head portion 29 frictionally engages the plastic tubing.

Each end of the elbow section 16 is adapted to receive a fastener, for example, through a threaded counterbore 20. One end receives head portion 29 of the plastic insert 28 and the threaded bolt 22 to secure that end to the tubular length 14. The opposite end is adapted to be mounted to a wall by mounting plate 30 which is secured to the end of the elbow section 16 by a fastener such as a flat head screw 34. Screw 34 is received within concave hole 32 in the mounting plate 30 and is secured, for example, by a threaded bore 20 in the elbow section 16. A plurality of mounting screws 38 secure the mounting plate 30 to the wall. A plastic cover 40 is provided for each elbow section and has a central opening to allow for telescopic engagement between the cover 40 and the elbow section 16. The plastic cover 40 has side walls 41 which are adapted to frictionally engage a circumferential flange 31 around the mounting plate 30 to hold the cover 40 in place and to conceal the mounting plate 30 and mounting screws 38.

Figure 9:
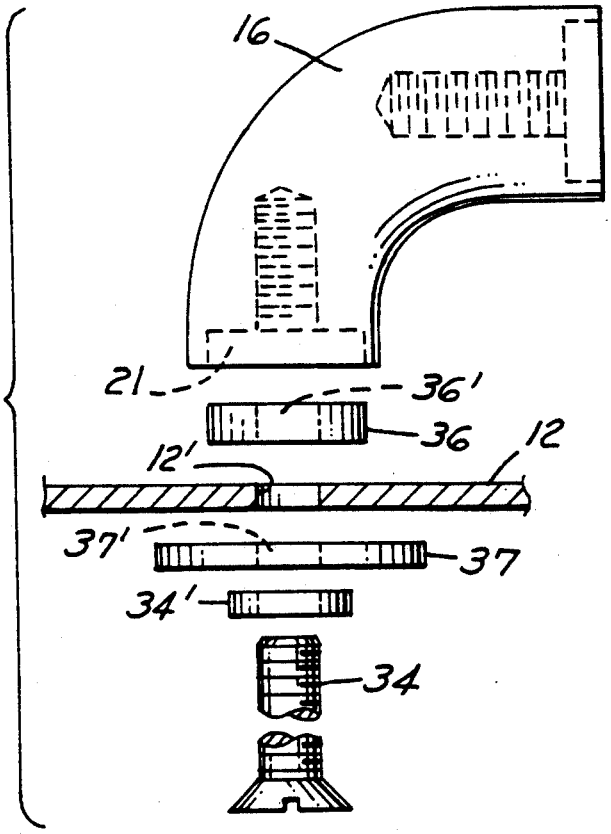
FIG. 9 is a fragmentary exploded assembly view of a third embodiment of the invention.

The elbow section 16 may be mounted to the wall without the mounting plate 30 when there is access to the back surface of the wall. In this instance (FIG. 9), a spacer or plug 36 is received within bore 21 in the elbow section 16. A backplate 37 is provided on the opposite side of the wall 12. The elbow 16 is secured to the wall by a fastener 34 and nut 34' with the fastener extending through a wall opening 12' and through openings 37' and 36' in the backplate 37 and plug 36.

A spacer 18, preferably made of luminous material, is provided for each connection between the tubular length 14 and each elbow section 16. The spacer 18 is adapted to telescopically engage head portion 29 of the plastic insert 28 to be received between the end of the elbow section 16 and the tubular length 14. As can be seen in FIG. 3, the elbow 16, O-ring spacer 18 and the tubular length 14 have the same outside diameter to form an assembly having a continuous cross section. The luminous spacer helps define the gripping portion and assists the user in locating the gripping portion in dark areas or when no light is available.

Figure 6:
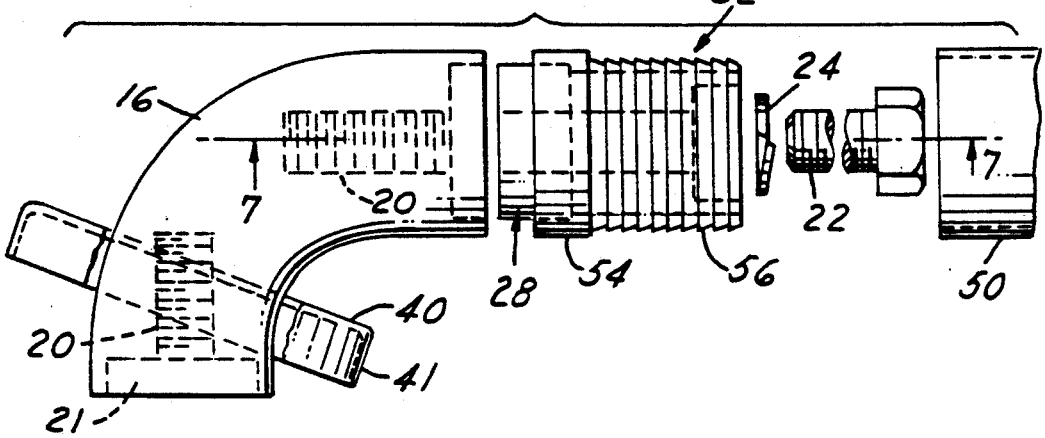
FIG. 6 is a fragmentary exploded assembly view of a second embodiment of the invention.
Figure 7:
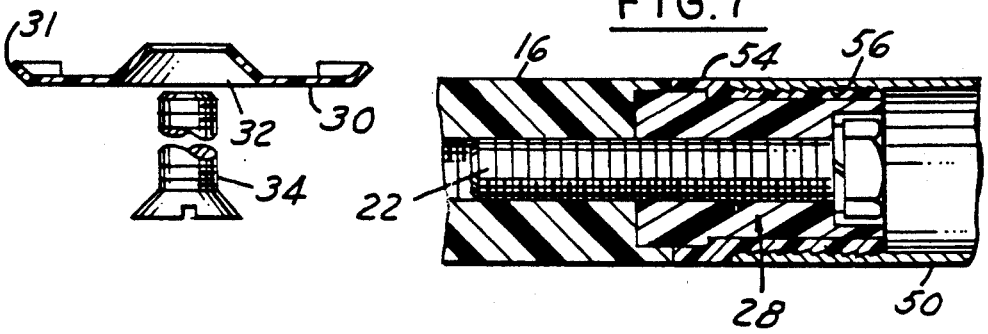
FIG. 7 is a sectional view of the assembled second embodiment through line 7—7 in FIG. 6.

A second embodiment of the invention is seen in FIGS. 6 and 7. In this form, the tubular length is made from an aesthetically pleasing material such as satin finished stainless steel or polished brass 50. The plastic insert 28 along with the threaded bolt 22 and lock washer 24 is press fit within a plastic serrated collar 52 which has a head portion 54 and saw toothed serrations along a shank portion 56. This subassembly is then press fit into the hollow metal tubular length 50. The saw toothed serrations along shank 56 provide frictional engagement with the inner surface of the metal tubular length 50 to prevent rotation. The tubular length 50 is then connected through the subassembly to the end of the elbow section 16 as described above. In this embodiment, the head portion 54 of the plastic collar 52 serves as a spacer between the end of the elbow section 16 and the tubular length 50. The plastic serrated collar 52 may be made of an illuminate or colored plastic. The head 54 of the plastic serrated collar 52 has the same outside diameter as both the elbow 16 and tubular length 50 to form a continuous cross section as seen most clearly in FIG. 7.

Figure 8:
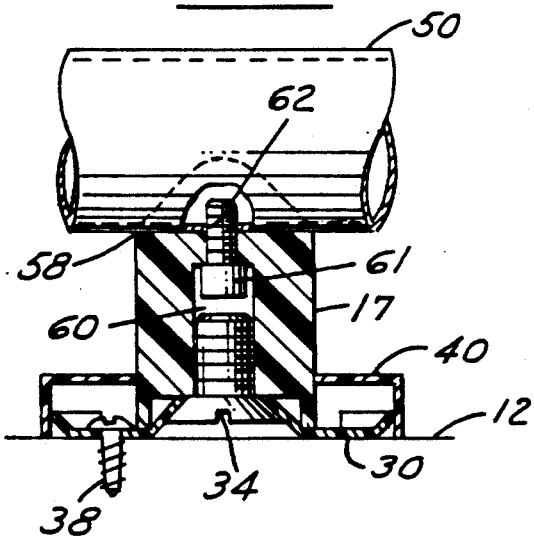
FIG. 8 is a fragmentary part sectional view of the hand rail with a center support.

Referring to FIG. 8, an additional center support 17 is shown in use with the tubular length 50 when additional support is needed. The center support 17 has an arcuate shaped end 58 adapted to receive the tubular length. The center support 17 has a through counterbore 60 adapted to receive a fastener 61 to secure the arcuate shaped end 58 to the tubular length 50 through a hole 62 in the tubular length 50. The counterbore 60 additionally receives flat head screw 34 and is adapted to be mounted to a wall by mounting plate 30 and covered with a plastic cover 40 in the same manner as described above with regard to the elbow section 16. The center support may also be used with the tubular length 14 as seen in FIG. 1 and connected thereto in the same manner.

It can thus be seen that there has been provided a modular hand rail which not only is aesthetically pleasing in appearance but is also simple to install. Various arrangements of the modular hand rail plus the use of different colors and materials provide design flexibility. Additionally, the present modular hand rail assists the user in locating the gripping surface in dark or low lit areas.

I claim:

1. A tubular wall mounted support comprising:
a length of tubular material;
a plastic elbow;
a plastic insert having an axial opening;
intermediate mounting means for connecting said insert to said tubular length;
fastening means extending through said axial opening in said plastic insert to connect said tubular length to said elbow,
spacer means secured between said tubular length and said elbow, and
wall mounting means to connect said elbow and said tubular length to a wall.

2. A support set forth in claim 1 wherein said tubular length is plastic and said intermediate mounting means comprises
a metal tube received within said plastic tubular length.

3. A support set forth in claim 2 wherein
said plastic insert has a press fit with said tubular length.

4. A support set forth in claims 3 further comprising longitudinal serrations on an outside surface of said plastic insert.

5. A support set forth in claim 1 wherein said tubular length is metal and said intermediate mounting means comprises
a plastic collar secured into one end of said metal tubular length.

6. A support set forth in claim 5 wherein
said plastic insert is press fit into said plastic collar.

7. A support as set forth in claim 5 further comprising toothed serrations at one end of said plastic collar for securing said plastic collar into said tubular length;
said plastic collar being press fit into said metal tubular length.

8. A support set forth in claim 1 wherein said wall mounting means comprises
a mounting plate having a concave hole and a circumferential flange,
fastening means extending through said concave hole to connect said mounting plate to said elbow, and
a cover having an opening for receiving said elbow and side walls on the periphery thereof to frictionally engage said circumferential flange on said mounting plate.

9. A support set forth in claim 1 wherein
said spacer is made of luminous material.

10. A support set forth in claim 2 wherein
said plastic tubular length is made of luminous material.

11. A support set forth in claim 5 wherein
said plastic collar is made of luminous material.

12. A support set forth in claim 1 further comprising longitudinal ribs along the length of said tubular length to provide a non-slip surface.

13. A support recited in claim 1 further comprising a plastic center support having a contoured radius at one end and a flat surface at the other end with a through opening adapted to receive a fastener for connecting said center support to said connecting sleeve.

14. A support set forth in claim 13 further comprising an additional mounting plate connected to the flat end of said center support by fastening means and an additional cover plate for concealing said mounting plate.

15. A support set forth in claim 1 further comprising
a second length of material,
a second elbow having ends,
a second plastic insert having an axial opening,
a second intermediate mounting means for connecting said insert to said tubular length,
a second fastening means extending through said axial opening in said plastic insert to connect said tubular length to said elbow, a second spacer means secured between said tubular length and said elbow, and a second wall mounting means to connect said elbow and said tubular length to a wall.

16. A support set forth in either claim 1 or 2 wherein said spacer is an O-ring.

17. A support set forth in claim 5 wherein said plastic collar comprises a shank and an enlarged head at one end of said shank, said enlarged head forming said spacer.

18. A support set forth in claim 1 wherein said tubular length, said elbow and said spacer have the same outside diameter so as to form a continuous cross section when connected.

19. A support set forth in claim 1 wherein said wall mounting means comprises a plug adapted to be received within said elbow for mounting to a wall surface, a backplate adapted to be secured to an opposite wall surface, and fastening means for connecting said backplate and said elbow to the wall.

* * * * *